US006513473B2

(12) United States Patent
Daut

(10) Patent No.: US 6,513,473 B2
(45) Date of Patent: Feb. 4, 2003

(54) DEVICE FOR VARYING VALVE TIMING OF GAS EXCHANGE VALVES IN INTERNAL COMBUSTION ENGINES, PARTICULARLY A HYDRAULIC CAMSHAFT ADJUSTING DEVICE OF A ROTARY PISTON TYPE

(75) Inventor: Klaus Daut, Herzogenaurach (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/918,066

(22) Filed: Jul. 30, 2001

(65) Prior Publication Data

US 2002/0020377 A1 Feb. 21, 2002

(30) Foreign Application Priority Data

Aug. 8, 2000 (DE) ..... 100 38 607

(51) Int. Cl.[7] ..... F01L 1/34
(52) U.S. Cl. ..... 123/90.17; 123/90.15
(58) Field of Search ..... 123/90.15, 90.16, 123/90.17, 90.31

(56) References Cited

FOREIGN PATENT DOCUMENTS

DE 19825287 12/1998

*Primary Examiner*—Thomas Denion
*Assistant Examiner*—Jaime Corrigan
(74) *Attorney, Agent, or Firm*—Bierman, Muserlian and Lucas

(57) ABSTRACT

A device (1) for varying the valve timing of gas exchange valves of an internal combustion engines, and the invention more particularly concerns a hydraulic camshaft adjusting device of a rotary piston type comprising a drive pinion (5) connected in driving relationship to a crankshaft, and a winged wheel (6) connected rotationally fast to a camshaft (4), the drive pinion (5) comprises a hollow space (10) defined by a circumferential wall (7) and two side walls (8, 9), a plurality of hydraulic working chambers being formed in the hollow space (10) by a plurality of limiting walls and the winged wheel (6) comprises a plurality of radial wings (14) that extend individually into the hydraulic working chambers (12) and divide these into first and second hydraulic pressure chambers (15, 16) which, when pressurized by a hydraulic pressure medium, effect a pivoting or a fixing of the winged wheel (6) relative to the drive pinion (6).

4 Claims, 3 Drawing Sheets

*A - A*

*B - B*

DEVICE FOR VARYING VALVE TIMING OF GAS EXCHANGE VALVES IN INTERNAL COMBUSTION ENGINES, PARTICULARLY A HYDRAULIC CAMSHAFT ADJUSTING DEVICE OF A ROTARY PISTON TYPE

FIELD OF THE INVENTION

The invention concerns a device for varying valve timing of gas exchange valves in an internal combustion engine, particularly a hydraulic camshaft adjusting device of a rotary piston type fixed on a drive-side end of a camshaft mounted in a cylinder head of the internal combustion engine while being generally configured as a hydraulic adjusting drive comprising:

a drive pinion connected in driving relationship to a crankshaft of the internal combustion engine and a winged wheel connected rotationally fast to the camshaft of the internal combustion engine, said drive pinion comprising a hollow space defined by a hollow cylindrical circumferential wall and two side walls, a plurality of hydraulic working chambers being formed in the hollow space by a plurality of radial limiting walls, a plurality of radial wings arranged on an outer periphery of a wheel hub of the winged wheel, said wings extending individually into the working chambers and dividing the working chambers into first and second oppositely acting hydraulic pressure chambers, a selective or simultaneous pressurizing of the pressure chambers by a hydraulic pressure medium effects a pivoting or a fixing of the winged wheel relative to the drive pinion, and thus, of the camshaft relative to the crankshaft.

BACKGROUND OF THE INVENTION

A generic hydraulic camshaft adjusting device of a rotary piston type is known from DE 197 45 908 A1. This device is fixed on the drive-side end of a camshaft mounted in the cylinder head of the internal combustion engine and is generally configured as a hydraulic adjusting drive. This device configured as a so-called vane-type adjusting device, generally comprises a drive pinion connected in driving relationship to a crankshaft of the internal combustion engine and a winged wheel connected rotationally fast to the camshaft of the internal combustion engine. The drive pinion comprises a hollow space formed by a hollow cylindrical circumferential wall and two side walls, four hydraulic working chambers being formed in the hollow space by four radial limiting walls. The winged wheel consequently comprises on the outer periphery of its wheel hub, four radial wings each of which extends into one working chamber of the drive pinion, so that the working chambers are divided into four first and four second oppositely acting hydraulic pressure chambers. By a selective or simultaneous pressurizing of these pressure chambers by a hydraulic pressure medium, a pivoting or a fixing of the winged wheel relative to the drive pinion is effected so that the camshaft is pivoted or hydraulically clamped relative to the crankshaft. The hydraulic pressure medium for this purpose is taken from the lubrication circuit of the internal combustion engine and routed through a pressure medium adapter arranged in extension of the camshaft in the cylinder head of the internal combustion engine, and through two separate pressure medium ducts extending in axial direction in the adapter and in the device, the pressure medium being supplied to and discharged from the individual pressure chambers through radial bores made in the wheel hub of the winged wheel.

A drawback of this prior art device is that the radial bores in the wheel hub which open into the individual pressure chambers of the device are relatively complicated and expensive to implement and, to avoid a malfunctioning of the device due to drilling chips, the bores have to be deburred and cleaned by high pressure washing. In most cases, the radial bores are additionally optically checked for cleanliness with special apparatus so that, due to the number of radial bores required in correspondence to the number of pressure chambers in the device, relatively high fabrication costs are incurred and disproportionately high capital investment is required for the necessary equipment and apparatus which disadvantageously increases the total manufacturing costs of such a device.

OBJECTS OF THE INVENTION

It is an object of the invention to provide a device for varying valve timing of gas exchange valves of an internal combustion engine, and more particularly to provide a hydraulic camshaft adjusting device of a rotary piston type in which the manufacturing costs and capital investment required for implementing the supply and discharge pressure medium ducts for the pressure chambers of the device are reduced to a minimum.

This and other objects and advantages of the invention will become obvious from the following detailed description.

SUMMARY OF THE INVENTION

The invention achieves its objects in a device of the pre-cited type by the fact that the supply and discharge of the hydraulic pressure medium to and from the pressure chambers of the device is effected through radial grooves that are made in the side walls of the drive pinion, first ends of the radial grooves open into the pressure chambers and second ends of the radial grooves open into further pressure medium ducts of the device, the radial grooves being sealed pressure medium-tight between their first and second ends by lateral surfaces of the wheel hub of the winged wheel.

In an advantageous embodiment of the invention, the radial grooves opening into the first pressure chambers of the device are made in one of the side walls of the drive pinion and the radial grooves opening into the second pressure chambers are made in the other of the side walls of the drive pinion. This simplifies the supply and discharge, described more closely below, of hydraulic pressure medium within the device to the respective radial grooves in the side walls. However, with an appropriately modified pressure medium supply and discharge, it is possible to make both the radial grooves opening into the first pressure chambers and those opening into the second pressure chambers only in one of the side walls of the drive pinion.

With regard to the fabrication costs of the side walls of the drive pinion, it has further proved to be particularly advantageous to make both the side walls with all their apertures and shaped portions without chip removal as stamped or stamped and drawn parts, and to make the radial grooves in the side walls likewise without chip removal, for example, by stamping or stamping and drawing combined with coining. Alternatively, it is, of course, also possible to machine the radial grooves into the side walls by milling. The side walls may also be comprised, for example, of an outer wall and an inner wall and be made as chiplessly stamped or stamped and drawn parts in which the radial grooves are coped out of the inner walls, the disadvantage, however, being the relatively high fabrication and material costs of this method of manufacture.

According to a further feature of the invention, in a preferred embodiment of the invention, the radial grooves in the side walls of the drive pinion are arranged so as to start in an already existing coaxial aperture of the side walls and extend radially in a straight line up to the level of the wing stop surfaces of the limiting walls of the drive pinion while being angularly spaced from one another in correspondence to the angular spacing of the wing stop surfaces of the limiting walls. The existing coaxial aperture of the side walls of the drive pinion in which the radial grooves start is configured in the camshaft-distal side wall preferably as a central bore, known per se, that is suitable for a fixing screw to pass through for fixing the device on the camshaft. When the device has been mounted, this bore is sealed pressure medium-tight by a screw cap. On the side wall nearer the camshaft, the coaxial aperture is likewise preferably configured as a central passage, known per se, that is suitable for allowing the passage of a fixing adapter between the device and the drive-side end of the camshaft, or the passage of the drive-side end of the camshaft itself. At its end nearer the camshaft, this passage forms a sleeve-like flange which is sealed pressure medium-tight relative to the cylinder head of the internal combustion engine by a shaft seal ring arranged on this flange. The angular spacing of the radial grooves from one another can be symmetric or asymmetric depending on a like or unlike configuration and arrangement of the limiting walls in the drive pinion. However, a like configuration and arrangement of the limiting walls in the drive pinion which makes possible a symmetric arrangement of the radial grooves in the side walls of the drive pinion is particularly advantageous because, then, the radial grooves in both side walls can be made absolutely identically. Irrespective thereof, the radial grooves in the camshaft-distal side wall always end parallel and directly next to the one wing stop surfaces of the limiting walls of the drive pinion, while the radial grooves in the side wall nearer the camshaft always end parallel and directly next to the respective other wing stop surfaces of the limiting walls of the drive pinion.

Finally, according to a last feature of the device of the invention, the hydraulic pressure medium for the device is taken from the lubrication circuit of the internal combustion engine out of the radial bearing of the camshaft in the cylinder head of the internal combustion engine. It is preferably routed through two annular channels made in the drive-side end of the camshaft and then transferred within the camshaft and the device through a plurality of radial bores of the annular channels into the aforementioned further pressure medium ducts that are connected to the radial grooves of the side walls of the drive pinion. In a specially preferred embodiment, these further pressure medium ducts are configured as separate axial channels formed by a pressure medium guide sleeve, known per se, surrounding the fixing screw. Pressure medium out of one of the annular channels of the camshaft is conveyed to and from the radial grooves of the side wall of the drive pinion nearer the camshaft along the outer surface of this guide sleeve and through further radial bores within the device. The pressure medium out of the other annular channel of the camshaft, in contrast, is conveyed along the inner surface of the guide sleeve into a hollow space for the head of the fixing screw of the device and from there, to the radial grooves of the camshaft-distal side wall of the drive pinion, and back. For this purpose, it is also possible to use a variety of other known embodiments of separate axial channels through which the hydraulic pressure medium from the annular channels on the drive-side end of the camshaft, or even from another pressure medium tapping point, can be supplied to the radial grooves in the side walls of the drive pinion from the lubrication circuit of the internal combustion engine or from a separate pressure medium circuit.

The device of the invention for varying valve timing of gas exchange valves in an internal combustion engine, particularly a hydraulic camshaft adjusting device of a rotary piston type, therefore has the advantage over prior art devices that the ducts for the supply and discharge of the hydraulic medium that open into the individual pressure chambers of the device have no longer to be drilled in a complicated and expensive manner in the wheel hub of the winged wheel but can be made as radial grooves without chip removal in the side walls of the drive pinion. Due to the chipless production of the pressure medium ducts, a cleaning of the radial grooves by high pressure washing and a subsequent optical check with special apparatus can be dispensed with, so that, due to the lower fabrication costs and capital investment, the total manufacturing costs of a device of this type are substantially reduced.

The invention will now described more closely with reference to an example of embodiment and the appended drawings.

DETAILED DESCRIPTION OF THE DRAWINGS

Figure 1:
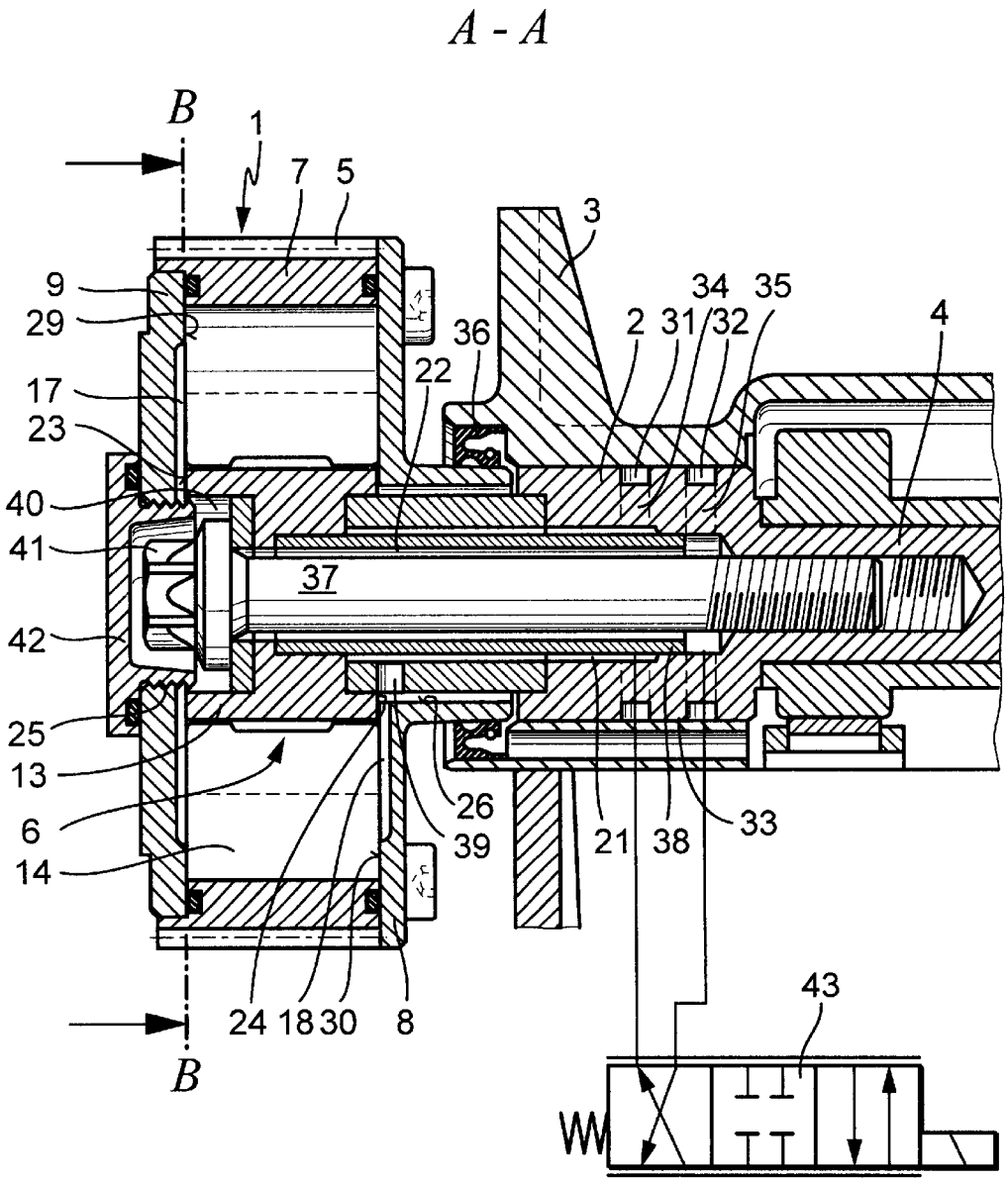
FIG. 1 is a cross-sectional view along line A—A of FIG. 2 through a rotary piston type camshaft adjusting device of the invention fixed on a camshaft in the cylinder head of an internal combustion engine.
Figure 2:
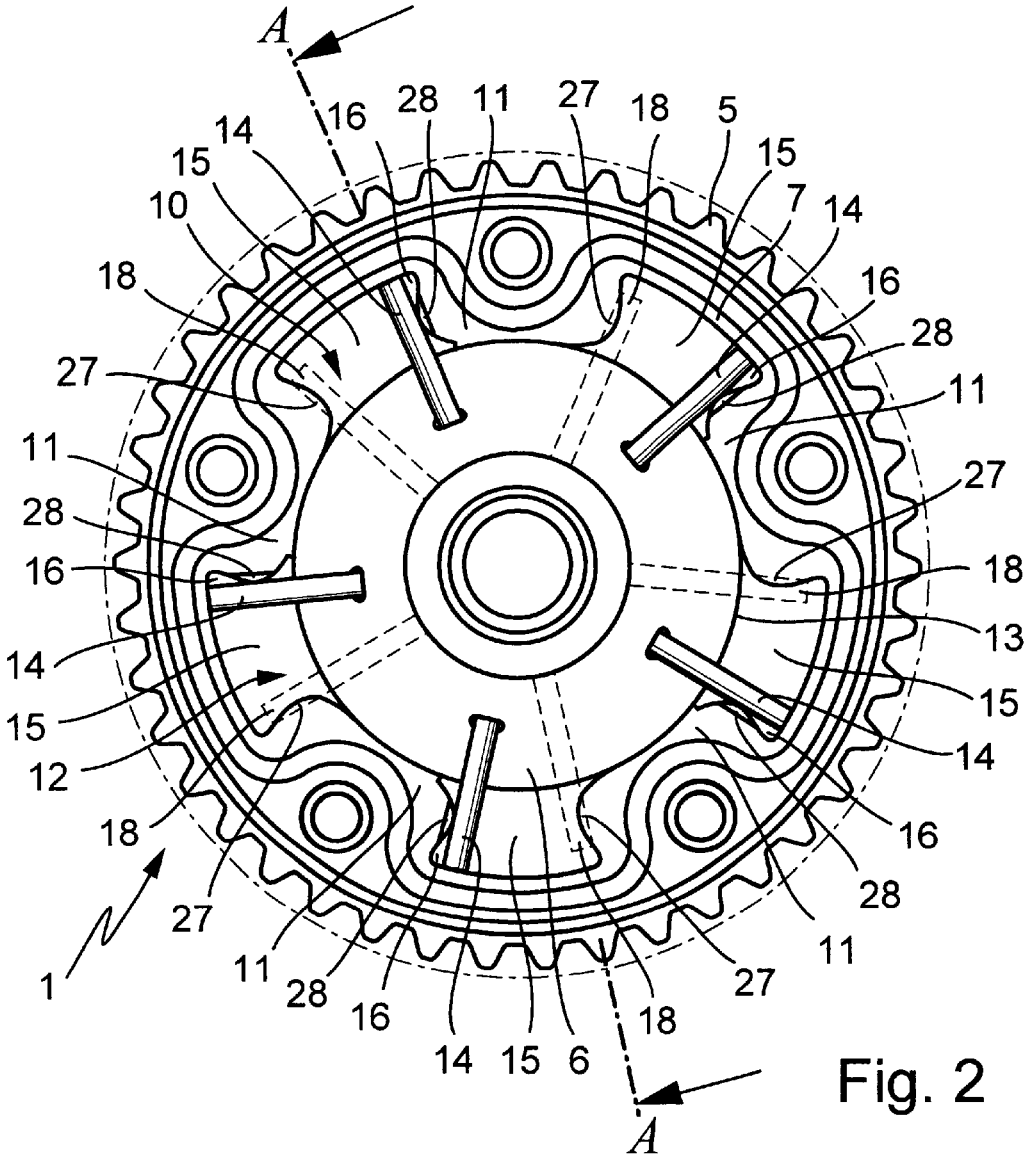
FIG. 2 is a top view of the rotary piston type camshaft adjusting device of the invention as viewed along the sectional line B—B of FIG. 1.

FIG. 1 clearly shows a camshaft adjusting device 1 of a rotary piston type for varying the valve timing of gas exchange valves of an internal combustion engine, that is fixed on the drive-side end 2 of a camshaft 4 mounted in the cylinder head 3 of the internal combustion engine. This device 1 is substantially configured as a hydraulic adjusting drive and comprises a drive pinion 5 that is connected in driving relationship to a crankshaft, not shown, of the internal combustion engine and a winged wheel 6 that is connected rotationally fast to the camshaft 4 of the internal combustion engine. FIGS. 1 and 2 further show that the drive pinion 5 of the device 1 comprises a hollow space 10 defined by a hollow cylindrical circumferential wall 7 and two side walls 8, 9, and five hydraulic working chambers 12 are formed in this hollow space 10 by five radial limiting walls 11. The winged wheel 6 of the device 1 comprises on the outer periphery of its wheel hub 13, five radial wings 14 extending individually into the working chambers 12 of the drive pinion 5 and dividing these into five first and five second oppositely acting hydraulic pressure chambers 15, 16. A selective or a simultaneous pressurization of these pressure chambers 15, 16 by a hydraulic pressure medium effects a pivoting or a fixing of the winged wheel 6 relative to the drive pinion 5 with the effect that the camshaft 4 is pivoted relative to the crankshaft or is hydraulically clamped in an adjusted position.

Figure 3:
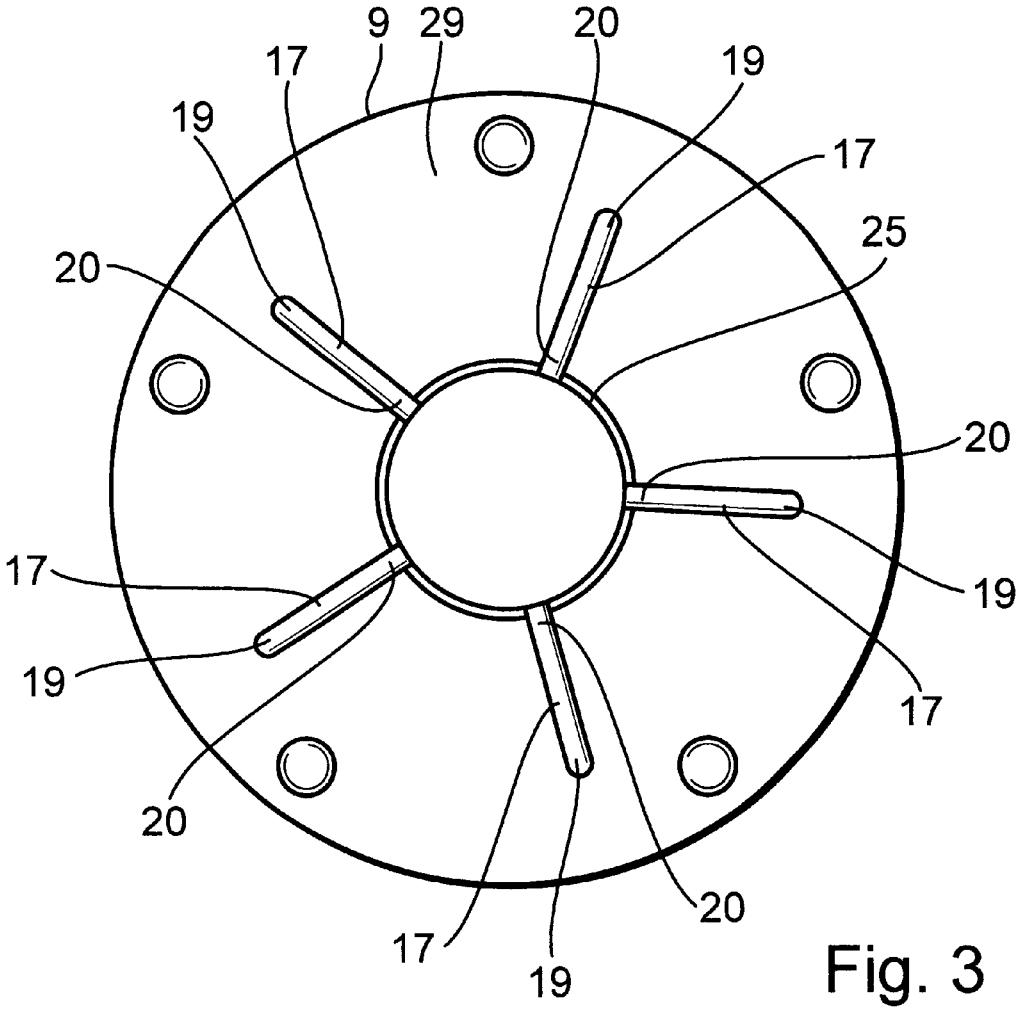
FIG. 3 is a top view of the camshaft-distal side wall of the drive pinion of the rotary piston type camshaft adjusting device of the invention.

FIGS. 1, 2 and 3 further clearly show that the supply and discharge of the hydraulic pressure medium to and from the pressure chambers 15, 16 of the device 1 is effected according to the invention by radial grooves 17, 18 made in the side walls 8, 9 of the drive pinion 5, one end 19 of each radial groove opening into the pressure chambers 15, 16 and the other end 20 of each radial groove opening into further pressure medium ducts 21, 22 of the device 1, the radial grooves 17, 18 being sealed pressure medium-tight between their two ends 19, 20 by the lateral surfaces 23, 24 of the wheel hub 13 of the winged wheel 6. As FIGS. 1 and 2 further show, the one side wall 9 of the drive pinion 5 comprises the radial grooves 18 that open into the first pressure chambers 15 of the device 1, while the other side wall 9 of the drive pinion 5, represented separately in FIG. 2, comprises the radial grooves 17 that open into the second pressure chambers 16 of the device 1. Both these side walls 8, 9 of the drive pinion 5, as represented including all the apertures and shaped portions, can be made without chip removal as stamped or stamped and drawn parts, and the radial grooves are pressed into the side walls 8, 9 likewise without chip removal by stamping or stamping and drawing combined with coining.

It can be further seen in FIGS. 1 to 3 that the radial grooves 17, 18 in both the side walls 8, 9 of the drive pinion 5 start at an already existing aperture 25, 26 in these side walls 8, 9 and extend therefrom radially in a straight line to end at the level of the wing stop surfaces 27, 28 of the limiting walls 11 of the drive pinion 5. The existing aperture 25 in the camshaft-distal side wall 9 of the drive pinion 5 is configured, as can be seen in FIG. 1, as a central bore suitable for a fixing screw 37 to pass through for fixing the device 1 on the camshaft 4. When the mounting of the device 1 on the camshaft 4 has been completed, this central bore is closed pressure medium-tight with a screw cap 42. As can likewise be seen in FIG. 1, the existing aperture 26 in the side wall 8 of the drive pinion 5 nearer the camshaft 4, is configured as a passage that is suitable for allowing the passage of a fixing adapter, not further specified, between the device 1 and the drive-side end 2 of the camshaft 4. In the direction towards the camshaft 4, this passage forms a sleeve-like flange and is sealed from the cylinder head 3 of the internal combustion engine by a shaft seal ring 36 arranged around this flange. The angular spacing of the radial grooves 17 and the radial grooves 18 in the inner surfaces 29 and 30 of the side walls 8 and 9, respectively, corresponds to the angular spacing of the wing stop surfaces 27 and 28, respectively, of the limiting walls 11 of the drive pinion 5, and as shown in FIGS. 2 and 3, in the present embodiment, this spacing is symmetric and identical in both side walls 8, 9 because all the five limiting walls 11 of the drive pinion 5 have identical, symmetric configurations.

Finally, the supply and discharge of hydraulic pressure medium to and from the pressure chambers 15, 16 of the device 1 through the radial grooves 17, 18 of the invention made in the side walls 8, 9 of the drive pinion 5 can likewise be understood from the representation of FIG. 1. As clearly shown, the hydraulic medium, controlled by an only schematically represented hydraulic directional valve 43, is taken from and returned to the lubrication circuit of the internal combustion engine within the radial bearing 33 of the camshaft 4 in the cylinder head 3 of the internal combustion engine through two annular channels 31, 32 made in the drive-side end 2 of the camshaft 4. The hydraulic pressure medium is conveyed from these annular channels 31, 32 through a plurality of radial bores 34, 35 into the further pressure medium ducts 21, 22 within the camshaft 4 and the device 1 that are connected to the radial grooves 17, 18 in the side walls 8, 9 of the drive pinion 5, the further pressure medium ducts 21, 22 that are configured as separate axial channels being formed by a pressure medium guide sleeve 38 surrounding the fixing screw 37 of the device 1. On the one hand, the hydraulic pressure medium is conveyed to and from the radial grooves 18 in the side wall 8 of the drive pinion 5 nearer to the camshaft through the one radial bores 34 in the camshaft 4 to flow along the outer surface of this hydraulic medium guide sleeve 38 and through further radial bores 39 within the fixing adapter of the device 1 and, on the other hand, it is transported through the other radial bores 35 in the camshaft 4 and further along the inner surface of the pressure medium guide sleeve 38 to flow into a hollow space 40 for the head 41 of the fixing screw 37 from where it is conveyed to the radial grooves 17 in the camshaft-distal side wall 9 of the drive pinion 5, and back.

What is claimed is:

1. A hydraulic camshaft adjusting device of a rotary piston type for varying valve timing of gas exchange valves in an internal combustion engine, said device being fixed on a drive-side end of a camshaft mounted in a cylinder head of the internal combustion engine while being generally configured as a hydraulic adjusting drive comprising:

a drive pinion connected in driving relationship to a crankshaft of the internal combustion engine and a winged wheel connected rotationally fast to the camshaft of the internal combustion engine, said drive pinion comprising a hollow space defined by a hollow cylindrical circumferential wall and two side walls, a plurality of hydraulic working chambers being formed in the hollow space by a plurality of radial limiting walls, a plurality of radial wings arranged on an outer periphery of a wheel hub of the winged wheel, said wings extending individually into the working chambers and dividing the working chambers into first and second oppositely acting hydraulic pressure chambers, a selective or simultaneous pressurizing of the pressure chambers by a hydraulic pressure medium effects a pivoting or a fixing of the winged wheel relative to the drive pinion, and thus, of the camshaft relative to the crankshaft, wherein a supply and discharge of the hydraulic pressure medium to and from the pressure chambers of the device is effected through radial grooves that are made in side walls of the drive pinion and open with first ends into the pressure chambers, second ends of the radial grooves open into further pressure medium ducts of the device, and the radial grooves are sealed pressure medium-tight between the first and second ends by lateral surfaces of the wheel hub of the winged wheel.

2. A hydraulic camshaft adjusting device of a rotary piston type for varying valve timing of gas exchange valves in an internal combustion engine, said device being fixed on a drive-side end of a camshaft mounted in a cylinder head of the internal combustion engine while being configured as a hydraulic adjusting drive comprising:

a drive pinion connected in driving relationship to a crankshaft of the internal combustion engine and a winged wheel connected rotationally fast to the camshaft of the internal combustion engine, said drive pinion comprising a hollow space defined by a hollow cylindrical circumferential wall and two side walls, a plurality of hydraulic working chambers being formed in the hollow space by a plurality of radial limiting walls, a plurality of radial wings arranged on an outer periphery of a wheel hub of the winged wheel, said wings extending individually into the working chambers and dividing the working chambers into first and second oppositely acting hydraulic pressure chambers, a selective or simultaneous pressurizing of the pressure chambers by a hydraulic pressure medium effects a pivoting or fixing of the winged wheel relative to the drive pinion, and thus, of the camshaft relative to the crankshaft, wherein a supply and discharge of the hydraulic pressure medium to and from the pressure chambers of the device is effected through radial grooves that are made in the side walls of the drive pinion and open with first ends into the pressure chambers, second ends of the radial grooves open into further pressure medium ducts of the device, and the radial grooves are sealed pressure medium-tight between the first and second ends by lateral surfaces of the wheel hub of the winged wheel, one of the side walls of the drive pinion comprises those of the radial grooves that open into the first pressure chambers of the device, while the other of the side walls of the drive pinion comprises those of the radial grooves that open into the second pressure chambers of the device, both the side walls of the drive pinion, together with all necessary apertures, are made without chip removal as stamped or stamped and drawn parts, and the radial grooves are made in the side walls likewise without chip removal by additional coining.

3. A device of claim 2 wherein the radial grooves in the side walls of the drive pinion start from an already existing coaxial aperture to extend radially in a straight line up to a level of wing stop surfaces of the limiting walls of the drive pinion, and the radial grooves are made in inner surfaces of the side walls of the drive pinion and are angularly spaced from one another in correspondence to an angular spacing of the wing stop surfaces of the limiting walls of the drive pinion.

4. A device of claim 1 wherein the hydraulic pressure medium is taken from a lubrication circuit of the internal combustion engine out of a radial bearing of the camshaft in the cylinder head of the internal combustion engine through two annular channels made in the drive-side end of the camshaft, and said annular channels are connected through a plurality of radial bores to the further pressure medium ducts that are arranged within the camshaft of the internal combustion engine while being configured as separate axial channels.

* * * * *